US005088416A

United States Patent [19]

Sabranski

[11] Patent Number: 5,088,416

[45] Date of Patent: Feb. 18, 1992

[54] IMPACT PROJECTILE

[75] Inventor: Udo Sabranski, Willich, Fed. Rep. of Germany

[73] Assignee: Rheinmetall Gmbh, Dusseldorf, Fed. Rep. of Germany

[21] Appl. No.: 86,760

[22] Filed: Oct. 18, 1979

[30] Foreign Application Priority Data

Oct. 19, 1978 [DE] Fed. Rep. of Germany ..... 2845431

[51] Int. Cl.[5] ..... F42B 12/04

[52] U.S. Cl. ..... 102/517; 102/506; 102/521

[58] Field of Search ..... 102/517-523, 102/531, 506

[56] References Cited

U.S. PATENT DOCUMENTS

| | | | |
|---|---|---|---|
| 3,986,456 | 10/1976 | Doin et al. | 102/531 |
| 4,108,072 | 8/1978 | Trinks et al. | 102/518 |
| 4,123,975 | 11/1978 | Mohaupt | 102/518 |
| 4,140,061 | 2/1979 | Campoli | 102/521 |

*Primary Examiner*—Harold J. Tudor
*Attorney, Agent, or Firm*—Herbert Dubno

[57] ABSTRACT

An impact projectile which comprises at least two impact bodies centered with respect to one another and disposed one axially behind the other with means for separating the two bodies axially upon approach to the target. The separation can be effected by thermal means controlled by a proximity switch and/or by flight duration. The projectile is especially designed for penetrating armored vehicles having multi-layer armored walls.

3 Claims, 3 Drawing Sheets

IMPACT PROJECTILE

CROSS REFERENCE TO RELATED APPLICATION

This application is related to the commonly assigned copending application Ser. No. 068,865 filed Aug. 21, 1979.

FIELD OF THE INVENTION

The present invention relates to an impact projectile and, more particularly, to a projectile designed to penetrate armored vehicles and comprising a plurality of bodies adapted to engage an armored vehicle wall successively.

BACKGROUND OF THE INVENTION

Modern armored vehicles are provided with multilayer, e.g. scale-like or lamella-like reinforced armored walls which represent multiple and structured targets which can be attached with high-velocity impact projectiles, e.g. subcaliber projectiles, only with difficulty. In practice, when the projectile consists of a single body adapted to impact as a unit against the armored wall, considerable energy is lost and the impact itself may result in a breakup of the projectile so that penetration is not achieved.

To improve the penetrability of projectiles against multiple and structured targets of the aforedescribed type, it has been proposed in U.S. Pat. No. 3,877,380 to provide a main core over which, in a cap-like manner, a plurality of pre-cores are provided so that a multiplicity of bodies of high kinetic energy engage the target successively. These various cores can be composed of the same material or of different materials, can be of the same size and mass or of different sizes and mass, and can be separated from one another by layers of soft-tempered copper.

The purpose of the cap-like configuration of the pre-cores is to prevent cracks from being generated in the body upon impact which cause the portions of the body to fall away from one another and reduce the penetration.

While such projectiles have an improved penetration over one-piece impact projectiles which lose a good part of their kinetic energy upon the initial contact of the leading portion of the projectile with the target, experience has shown that the multi-core arrangement does not have maximum penetrability and can be fabricated only with difficulty.

The aforedescribed copending application represents an improvement over the earlier system and describes a subcaliber projectile designed to be fired from a smooth-bore barrel and which is fin-stabilized and provided with a drive cage.

A still earlier copending and commonly assigned application, Ser. No. 949,067 filed Sept. 5, 1978, describes a multi-core projectile with individual cores adapted to impact at high kinetic energy against structured and multilayered armored vehicles.

OBJECTS OF THE INVENTION

It is the principal object of the present invention to provide an impact projectile which represents an improvement over the prior-art systems mentioned earlier and those of the earlier commonly assigned copending applications.

Another object of the invention is to provide an impact projectile which is especially effective against multiple and structured targets, i.e. laminated or multi-layer reinforced or armored vehicles, even when the projectile encounters the target at a relatively flat attack angle, which can be constructed simply and is free from the manufacturing difficulties hitherto encountered.

Still another object of the invention is to improve upon the systems described in the above-mentioned copending applications.

SUMMARY OF THE INVENTION

The impact projectile according to the invention comprises a plurality of impact bodies which are centered with respect to one another and are axially aligned in the direction of travel of the projectile but which are releasably connected together so as to separate after a predetermined flight time, preferably proximal to the target. In other words, after a predetermined flight time, the axial connection of the portions of the projectile is released or disengaged.

According to a feature of the invention, the bodies of the projectile are provided with an axial bore traversed by a throughgoing rod or bar which is fixed to the first and/or last of these bodies releasably while means is provided to spread the bodies apart upon such release. The release can be effected by thermal means, e.g. a body of low melting point which can, for example, be thermally activated by the heat produced as the projectile encounters the air ahead of the traveling projectile or by a proximity switch.

Best results have been found to be obtained when elastic spreading means, e.g. a so-called Belleville or dished-disk washer or spring, is provided between each pair of successive projectile bodies.

The impact projectile of the present invention thus enables the individual projectile bodies or penetrating bodies, to separate from one another in axial alignment after a predetermined time of flight so that they impact successively with a predetermined interval between them against the target.

In this manner each impact body attacks the target independently of the effect of the attack of any preceding body so that there is no rebound effect or loss of kinetic energy of the successive bodies upon impact of a preceding body.

The projectile or portions thereof cannot be destroyed upon impact of the leading portion of the projectile against the target and each of the subsequently impacting projectile bodies impacts against the target with its full kinetic energy.

The release of the axial connection between the axially aligned bodies can be effected in various ways, alluded to earlier. For example, a proximity switch or detector responsive to the distance of the projectile from the target can induce the release by activating a squib or activating a thermally responsive member or the temperature which is developed at the nose of the projectile by its passage through the atmosphere at high velocity can be used to melt a fusible locking element.

While the desired spacing can be effected solely by air friction, it has been found to be advantageous to provide the elastic spreading means mentioned previously.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
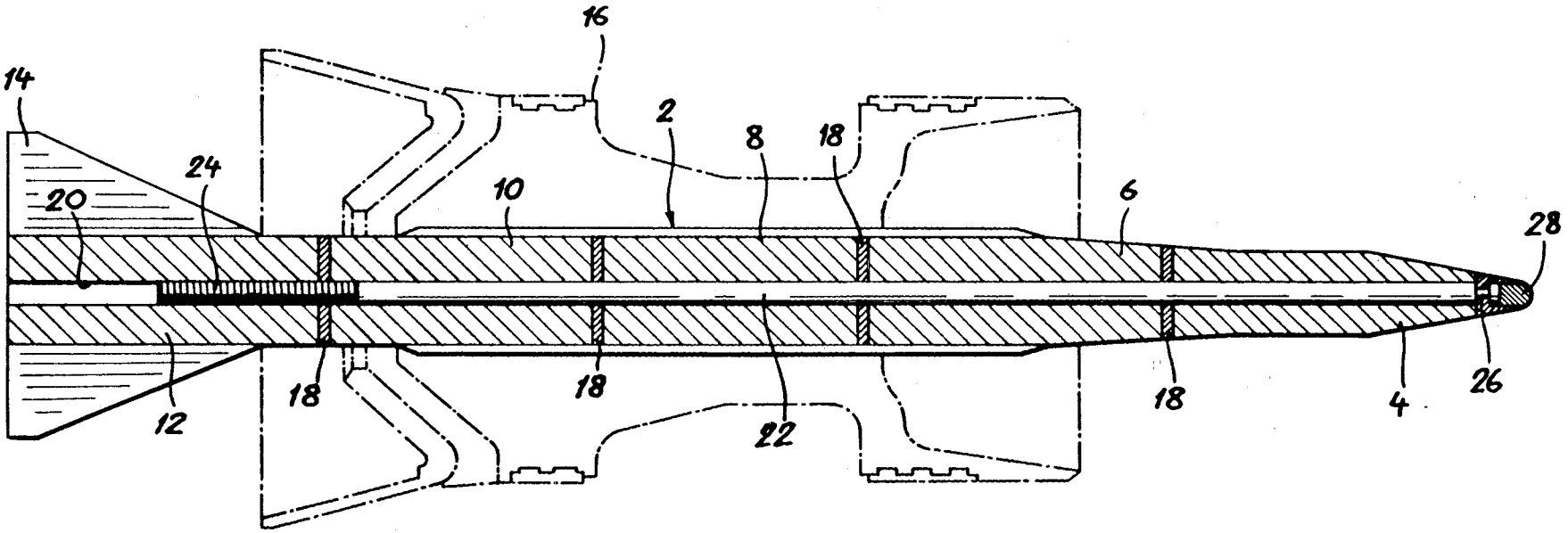
FIG. 1 is a view of a subcaliber projectile, in axial cross section, prior to separation of the parts thereof and in readiness for firing.
Figure 2:
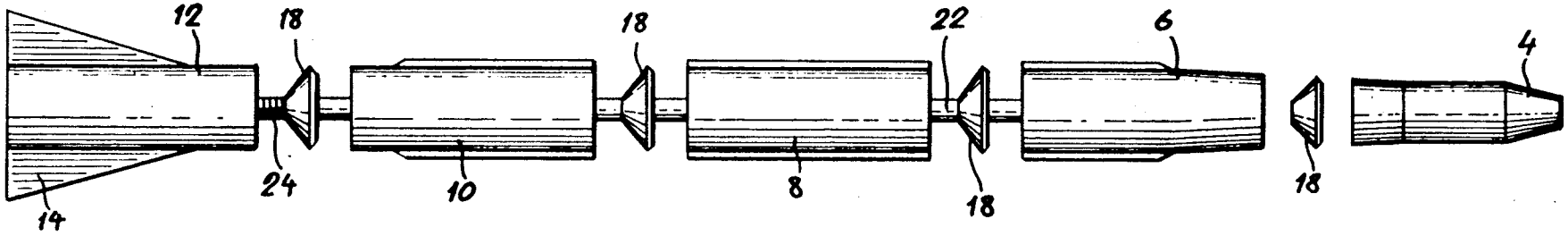
FIG. 2 is an elevational view of the projectile prior to encountering the target and after separation of the impact bodies.

The projectile shown in FIGS. 1 and 2 can be of the type otherwise illustrated and described in the aforementioned copending applications, i.e. a subcaliber projectile adapted to be fired from a smooth-bore barrel against a multiple-armored target such as a tank, armored personnel carrier or armored weapons carrier. In the application Ser. No. 068,865 filed Aug. 21, 1979, for example, there is described a projectile which is received in a cartridge casing and has a fin-stabilized structure with a drive cage separating upon emergence of the projectile from the barrel. A similar structure can be applied here.

Thus the subcaliber projectile 2, which has a pointed or arrow shape, comprises a plurality of impact bodies, namely, a pointed nose 4 and three successively disposed impact bodies or cores 6, 8, 10, as well as a tail body 12 with a fin structure 14 for stabilizing the projectile.

The principles of such multiple-impact bodies are described in the aforementioned application Ser. No. 949,067 filed Sept. 5, 1978.

The impact bodies 4, 6, 8, 10, 12 all have axial longitudinal bores 20 in which a rod 22 is received with such clearance or tolerance that an axial mobility of the members 6, 8, 10, 12 relative to the rod 22 is possible. A threaded portion 24 of the rod 22 is screwed into the tail body 12.

At its forward end, the rod 22 is turned down at 26 and carries a cap 28 which can be soldered or otherwise fused to the rod 22.

Between each pair of impact bodies 6, 8; 4, 6; 8, 10 and 10, 12 there are provided respective dished-disk springs or Belleville washers represented at 18 which, upon removal of the cap 28 from the rod 22, drive the bodies 4, 6, 8, 10, 12 axially apart (see FIG. 2) for successive and independent impacts against the target.

The subcaliber projectile 2 carries the drive cage 16 for firing from the smooth-barrel weapon in the manner previously described. The details of the drive cage 16 and its connection with the subcaliber projectile 2 can correspond to those shown and described in German patents 17 03 507 and 22 36 142.

As previously mentioned, the cap 28 is composed of a metal of low melting point, e.g. Woods metal alloy, the melting point being selected so that, when the subcaliber projectile 2 travels at its usual speed which can be a multiple of the speed of sound, the temperature developed at the nose or cap 28 is sufficient to cause melting of the cap to release the rod 22.

As FIG. 2 shows, the spring 18 drives the projectile bodies apart so that they successively and independently from one another impact against the target.

The mass and melting point of the cap 28 are so selected that the projectile has the desired flight time before separation occurs.

Figure 3:
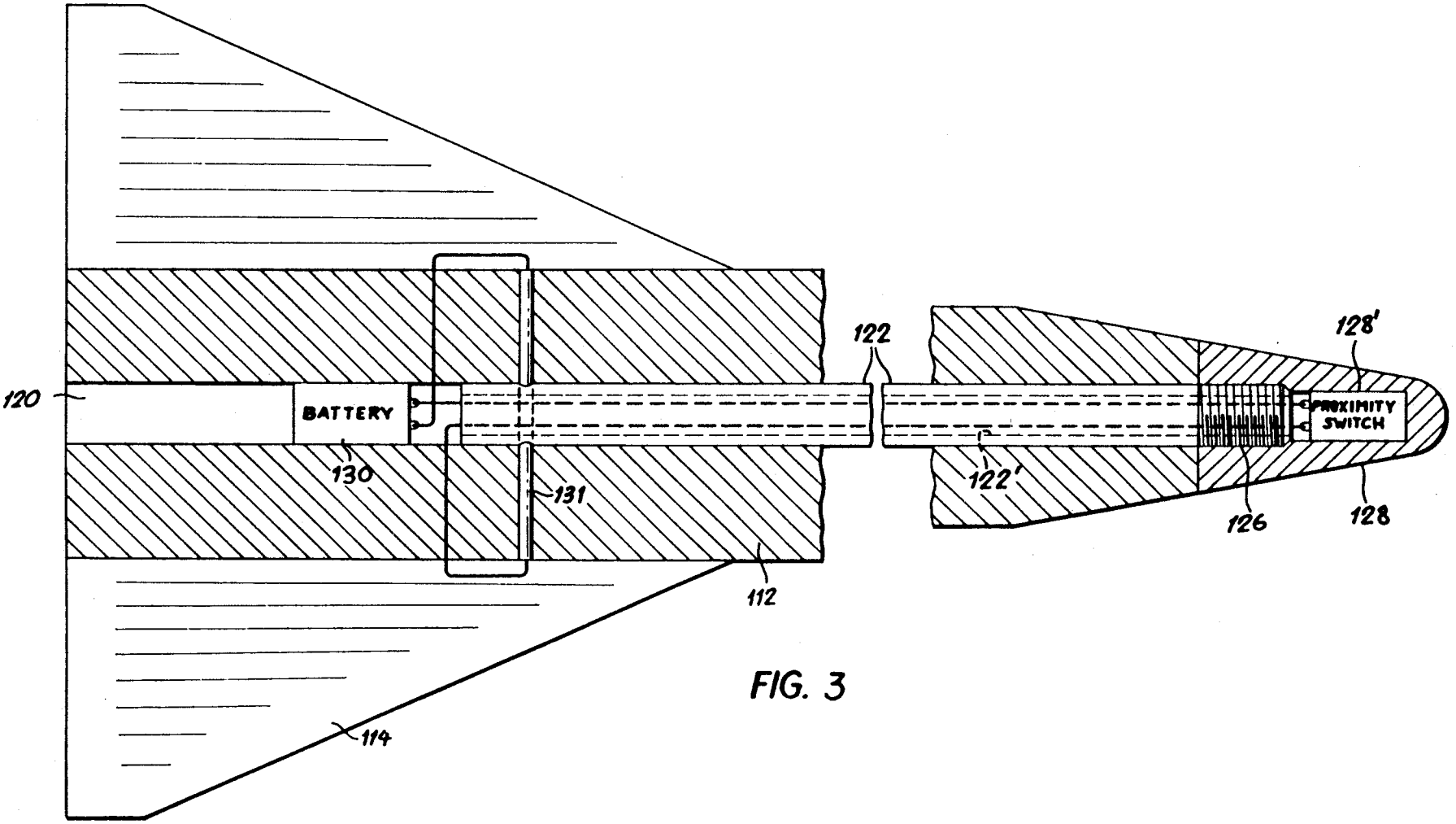
FIG. 3 is a fragmentary view illustrating another embodiment of the projectile of the present invention.

As can be seen from FIG. 3, the cap 128 may also contain a proximity switch or other proximity detector, represented generally at 128', which responds to a predetermined distance of the projectile from the target, and which can connect a battery 130 in series with a fusible pin 131 connecting the tail body 112 to the rod 122. The latter may be formed with a central bore 122' through which the wires necessary for the connection are provided. For safety purposes, the cap 128 may also be composed of fusible metal and can be threaded at 126 to the rod 122. The tail piece 112 utilizes the rear portion of the bore 120 to receive the battery 130. The fin-stabilizing structure has been represented at 114. In place of the pin 131, an explosive squib can be activated to separate the tail piece 112 from the rod 122. Alternatively, a squib or like proximity switch activated member can disconnect the cap 128 from the rod 122.

The effect of the spacing of the bodies 4, 6, 8, 10, 12 from one another by releasing the connection at least at one end of the rod, is comparable to the effect achieved with hollow charges whose maximum penetration obtains when the individual particles upon impact have a predetermined spacing from one another. This spacing in the case of a hollow charge is a result of the intrinsic velocity gradient which is characteristic thereof. A penetration which is optimized to a maximum because of the spacing as a function of flight time of the particles resulting from the use of a hollow charge is comparable to the optimization of penetration obtained with the present invention whether the separation of the bodies is brought about solely by friction or also with the aid of the elastic members.

I claim:

1. An impact projectile for firing from a smooth-bore barrel-type weapon such as a tank for targeting on an armored wall, comprising:

a plurality of axially aligned, axially spaced, elongated annular impact bodies including a nose body at a leading end of said projectile, a tail body at a trailing end of said projectile, and a plurality of intermediate bodies between said nose body and said tail body whereby said bodies are adapted to successively engage said wall, all of said bodies being formed with axial bores;

a rod extending through said bores and anchored to said tail body at a trailing end of said body;

respective dished-disk springs received between each body and the next body along said rod and forming elastic spreading means for biasing said bodies apart;

means at said nose body releasably engaging a leading end of said rod for retaining said bodies against relative axial movement and axial movement relative to said body and simultaneously maintaining each of said dished-disk springs under compression until release of said means;

a fin-stabilizing structure on said tail body; and a drive cage surrounding at least some of said bodies whereby said projectile forms a subcaliber projectile for said barrel-type weapon.

2. The impact projectile defined in claim 1 wherein said means is a material of a low melting point fixed to said leading end of said body and fusible to release said bodies for relative movement of said bodies and movement of said bodies relative to said rod by said springs.

3. The impact projectile defined in claim 1 wherein said means includes a proximity detector provided on said nose body and connected to a member adapted to be energized by said detector at said leading end of said body for releasing said bodies for relative displacement and for relative displacement of said bodies with respect to said rod by said springs.

* * * * *